US008453398B1

(12) United States Patent
Atkins et al.

(10) Patent No.: US 8,453,398 B1
(45) Date of Patent: Jun. 4, 2013

(54) ROLLING CABINET SUPPORT SYSTEM

(75) Inventors: Robert G. Atkins, Poughkeepsie, NY (US); Eric J. McKeever, Poughkeepsie, NY (US); Edward J. Seminaro, Milton, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/433,733

(22) Filed: Mar. 29, 2012

(51) Int. Cl.
*E04C 2/52* (2006.01)

(52) U.S. Cl.
USPC ..... 52/220.1; 52/220.2; 52/220.5

(58) Field of Classification Search
USPC ..... 52/174–176, 220.1, 220.2, 220.5, 52/220.8, 263, 506.1, 518, 519; 14/69.5, 14/71.1
See application file for complete search history.

(56) References Cited

U.S. PATENT DOCUMENTS

| | | | | |
|---|---|---|---|---|
| 4,693,418 | A | 9/1987 | Peterman | |
| 4,807,317 | A * | 2/1989 | Quinn et al. | 14/69.5 |
| 4,817,224 | A | 4/1989 | Visnaw et al. | |
| 4,942,708 | A * | 7/1990 | Krumholz et al. | 52/263 |
| 5,341,533 | A | 8/1994 | Seitz | |
| 5,446,937 | A | 9/1995 | Haskins | |
| 5,465,534 | A * | 11/1995 | Mittag | 52/126.6 |
| 5,467,609 | A | 11/1995 | Feeney | |
| 5,901,395 | A | 5/1999 | Vander Heiden et al. | |
| 6,148,577 | A | 11/2000 | Smolenski et al. | |
| 6,598,366 | B2 * | 7/2003 | Hsieh et al. | 52/506.01 |
| 6,684,582 | B2 | 2/2004 | Peart et al. | |
| 6,718,588 | B1 * | 4/2004 | Frederiksen | 14/69.5 |
| 7,104,524 | B1 | 9/2006 | Hidding et al. | |
| 7,571,507 | B2 | 8/2009 | Holicki | |
| 7,690,160 | B2 | 4/2010 | Moller et al. | |
| 7,955,679 | B2 | 6/2011 | Duprez | |
| 2002/0124332 | A1 * | 9/2002 | Janowak | 14/69.5 |
| 2002/0157331 | A1 * | 10/2002 | Peart et al. | 52/220.2 |
| 2003/0097808 | A1 * | 5/2003 | Sabatini | 52/384 |
| 2006/0016136 | A1 | 1/2006 | Moller | |
| 2007/0163195 | A1 | 7/2007 | Jenkins | |

* cited by examiner

*Primary Examiner* — Brian Glessner
*Assistant Examiner* — Adam Barlow
(74) *Attorney, Agent, or Firm* — Cantor Colburn LLP; Dennis Jung

(57) ABSTRACT

A support system is provided and includes first and second raised floor tiles, a ramp and sheeting. The ramp includes first and second edges and is disposable with the first edge adjacent to the first raised floor tile and the second edge adjacent to the second raised floor tile. The ramp has a substantially similar thickness as the first raised floor tile at the first edge and a different thickness from the second raised floor tile at the second edge. The sheeting is disposable on the second raised floor tile to abut the second edge of the ramp and has a thickness such that a combined thickness of the sheeting and the second raised floor tile is substantially similar to the thickness of the ramp at the second edge.

18 Claims, 7 Drawing Sheets

ROLLING CABINET SUPPORT SYSTEM

This invention was made with Government support under Contract No. HR0011-07-9-0002, awarded by the Defense Advanced Research Projects Agency (DARPA). The Government has certain rights in this invention.

BACKGROUND

Aspects of the present invention relate to a support system and, more particularly, to a support system for a rolling cabinet to house information technology (IT) components.

Cabinets for IT equipment that are located on raised floors are becoming heavier and heavier due to component density increases. Many of these cabinets have casters that can easily scratch or mar the tiles of the raised floors when the cabinet is rolled across them. Currently, sheeting made from polycarbonate, aluminum, steel or wood is typically arranged on top of the raised floor tiles to create a path for the cabinet to roll across.

Sheeting has at least two main drawbacks. The first drawback is that it can be very difficult to get the cabinet from the raised floor onto the sheeting due to the edge step in the sheeting. The second drawback is that the pieces of sheeting tend to separate or deform when a cabinet is rolled across them. Such separation or deformation can create gaps at the seams or cause the sheeting to overlap. Gaps and overlaps are difficult for the cabinet casters to roll over.

SUMMARY

According to an aspect of the present invention, a support system is provided and includes first and second raised floor tiles, a ramp and sheeting. The ramp includes first and second edges and is disposable with the first edge adjacent to the first raised floor tile and the second edge adjacent to the second raised floor tile. The ramp has a substantially similar thickness as the first raised floor tile at the first edge and a different thickness from the second raised floor tile at the second edge. The sheeting is disposable on the second raised floor tile to abut the second edge of the ramp and has a thickness such that a combined thickness of the sheeting and the second raised floor tile is substantially similar to the thickness of the ramp at the second edge.

According to another aspect of the present invention, a support system is provided and includes a substrate on which stanchions and cross-beams are arrayed, first and second raised floor tiles and a ramp supported by the stanchions and cross-beams above the substrate and sheeting. The ramp includes first and second edges and is disposable with the first edge adjacent to the first raised floor tile and the second edge adjacent to the second raised floor tile. The ramp has a substantially similar thickness as the first raised floor tile at the first edge and a different thickness from the second raised floor tile at the second edge. The sheeting is disposable on the second raised floor tile to abut the second edge of the ramp and has a thickness such that a combined thickness of the sheeting and the second raised floor tile is substantially similar to the thickness of the ramp at the second edge.

According to yet another aspect of the present invention, a support system is provided and includes a ramp and sheeting. The ramp has a lead portion and a rear portion. The lead portion is formed as a ramp element and the rear portion is formed as a landing with a first lap joint flange. The sheeting has first and second offset layers, which are offset from one another to form a second lap joint flange. The ramp and the sheeting are disposable such that the first and second lap joint flanges mate with respective upper surfaces of the ramp and the sheeting having substantially similar heights.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

In accordance with aspects of the present invention, a system is provided to facilitate the installation, relocation or un-installation of large and heavy information technology (IT) cabinets with respect to a raised floor without damaging the floor tiles or other flooring in the path leading between a target location and, for example, a loading dock.

Figure 1:
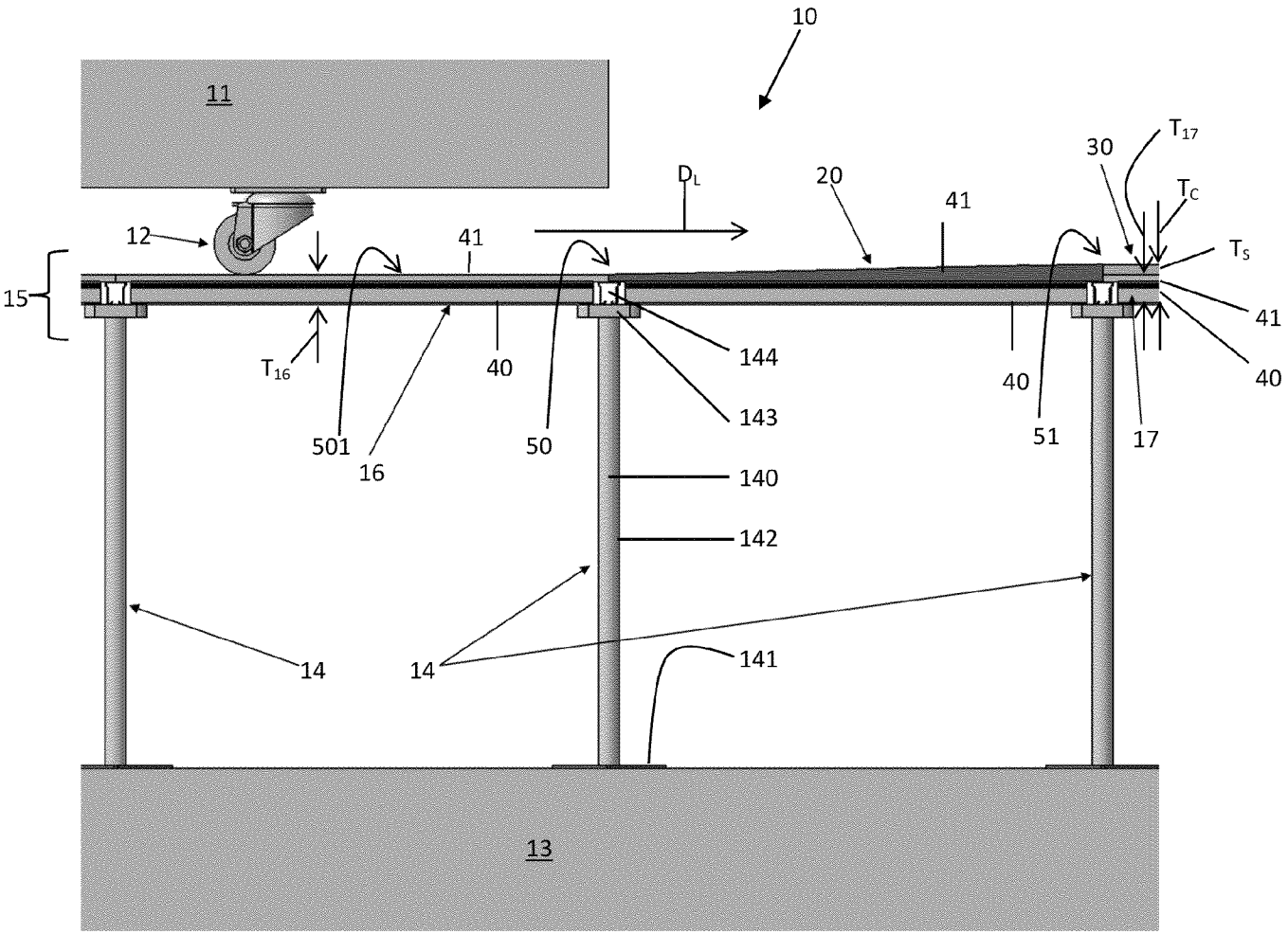
FIG. 1 is a side view of a support system for a rolling cabinet in accordance with embodiments of the present invention.

With reference now to FIG. 1, a support system 10 is provided and may be used to facilitate the movement of an IT cabinet 11. The cabinet 11 may be relatively heavy (e.g., in excess of 1,000 lbs.) and is provided with casters 12. The casters 12 enable the cabinet 11 to be rolled. The support system 10 includes a substrate 13, such as a base floor made of concrete or another similar material, a plurality of supports 14 that are arrayed on the substrate 13 to support a tile floor 15 above the substrate 13 and at least first and second raised floor tiles 16 and 17. The first and second raised floor tiles 16 and 17 along with any number of additional raised floor tiles can be disposed to form the tile floor 15 as a substantially flat surface above the substrate. The support system 10 further includes a ramp 20 and sheeting 30. The sheeting 30 may be formed of at least one or more of polycarbonate, aluminum, steel and wood.

The supports 14 include a plurality of stanchions 140 and a plurality of cross-beams 144. Each of the stanchions 140 includes a foot pad 141, a shaft 142 and a head 143. The foot pad 141 sits on the substrate 13 and has a relatively wide diameter as compared to the shaft 142 for balance and support. The shaft 142 may be adjustable in at least the vertical direction. The head 143 has a wider diameter than the shaft 142 but need not be as wide as the foot pad 141.

The stanchions 140 are arrayed in a square matrix arrangement with the cross-beams 144 sitting on the heads 143 and extending, for example, in both column and row formats to define square tile locations in which the first and second raised floor tiles 16 and 17 and the ramp 20 are disposable (and from which the first and second raised floor tiles 16 and 17 and the ramp are removable by suction). Of course, it is to be understood that other configurations of the stanchions 140 and the cross-beams 144 are possible as long as the first and second tiles 16 and 17 and the ramp 20 can be fit in the shapes defined by the cross-beams 144.

Each of the first and second raised floor tiles 16 and 17 and the ramp 20 includes a base portion 40 and a surface portion 41 that overhangs outwardly from a peripheral edge of the base portion 40. The base portion 40 is generally rigid while the surface portion 41 may be rigid and formed of a low friction material such that the casters 12 of even heavy equipment can be easily moved. The rigidity of the base portion 40 and the surface portion 41 is variable and defines a weight rating of the first and second floor tiles 16 and 17 and the ramp 20 that should not be exceeded by the weight of the cabinet 11.

When the first and second raised floor tiles 16 and 17 are disposed in the support system 10, corners of the respective base portions 40 sit atop the heads 143 of corresponding stanchions 140 while edges of the respective surface portions 41 sit atop corresponding cross-beams 144. When the ramp 20 is similarly disposed in the support system 10, the ramp 20 is disposed between the first and second raised floor tiles 16 and 17 with the corners of the base portion 40 of the ramp 20 sitting atop the heads 143 of corresponding stanchions 140 and edges of the surface portion 41 sitting atop corresponding cross-beams 144.

As shown in FIG. 1, the edges of the respective surface portions 41 extend approximately halfway across the corresponding cross-beams 144 and abut complementary edges of adjacent surface portions 41. Thus, an external force acting on the ramp 20 that is exerted in the lateral direction $D_L$ by, for example, the casters 12, which would normally cause the ramp 20 to move laterally, would be prevented from doing so by the abutment of the surface portion 41 of the ramp 20 with the surface portion 41 of the second raised floor tile 17.

Figure 2:
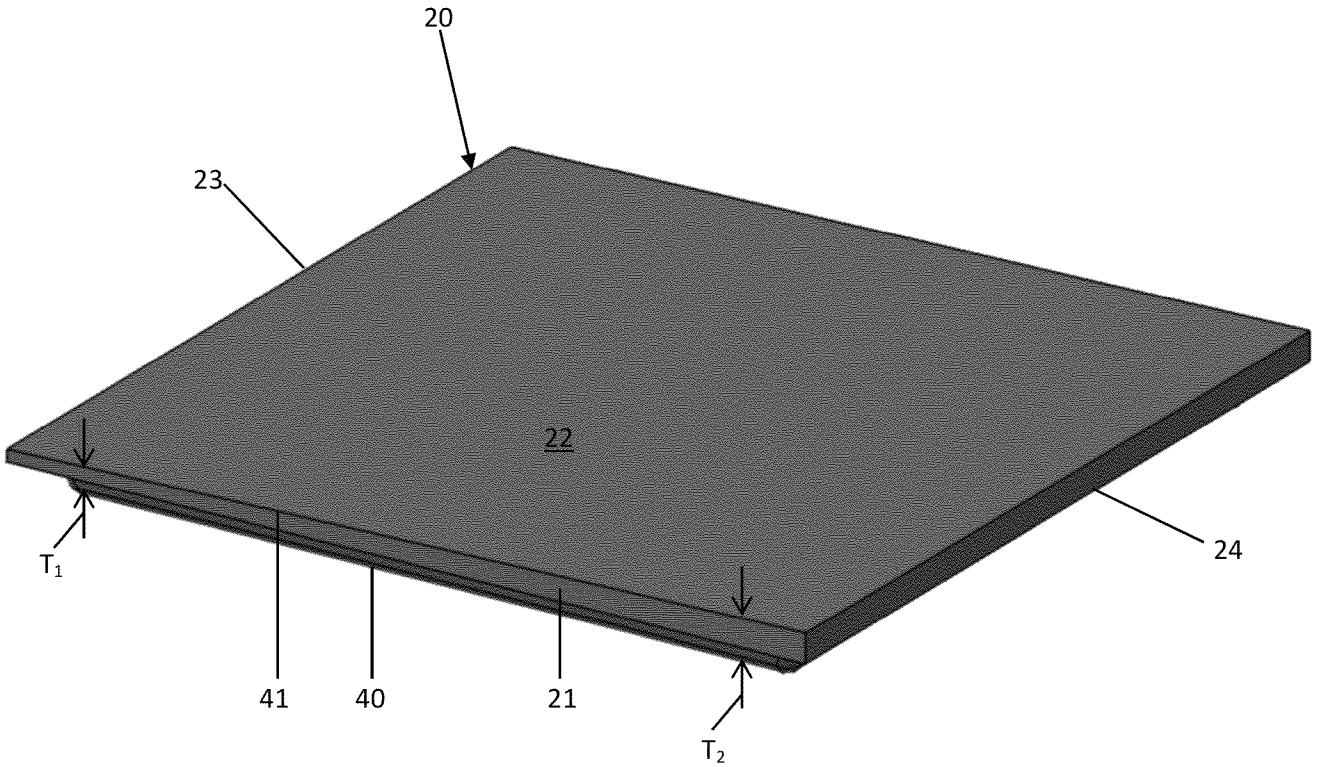
FIG. 2 is a perspective view of a ramp of the support system of FIG. 1.

With reference to FIGS. 1 and 2, the ramp 20 has a body 21 with an upper surface 22 and first and second edges 23 and 24. The first and second edges 23 and 24 may be defined on opposite sides of the body 21 and, when the ramp 20 is disposed between the first and second raised floor tiles 16 and 17, the first edge 23 is adjacent to the first raised floor tile 16 and the second edge 24 is adjacent to the second raised floor tile 17. The body 21 has a first thickness $T_1$ at the first edge 23, which is substantially similar to a thickness $T_{16}$ of the first raised floor tile 16 and a second thickness $T_2$ at the second edge 24, which is different from a thickness $T_{17}$ of the second raised floor tile 17.

With these dimensions, when the ramp 20 is disposed between the first and second raised floor tiles 16 and 17, a first relatively smooth transition 50 is defined between an upper surface 501 of the first raised floor tile 16 and the upper surface 22 of the ramp 20 at or around the first edge 23. By contrast, an upper surface 502 (see FIG. 3) of the second raised floor tile 17 is recessed from the upper surface 22 of the ramp 20 at or around the second edge 24.

The thickness of the sheeting 30 accounts for the recess of the upper surface 502 of the second raised floor tile 17 with respect to the upper surface 22 of the ramp 20 at or around the second edge 24. To this end, the sheeting 30 may be disposed on the upper surface 502 of the second raised floor tile 17 in abutting contact with the second edge 24 of the ramp 20. In accordance with embodiments, the sheeting 30 has a thickness $T_S$ such that a combined thickness $T_C$ of the sheeting 30 and the second raised floor tile 17 is substantially similar to the second thickness $T_2$ of the ramp 20 at the second edge 24. With these dimensions, when the ramp 20 is disposed between the first and second raised floor tiles 16 and 17, a second relatively smooth transition 51 may be defined between an upper surface 503 of the sheeting 30 and the upper surface 22 of the ramp 20 at or around the first edge 24.

Figure 3:
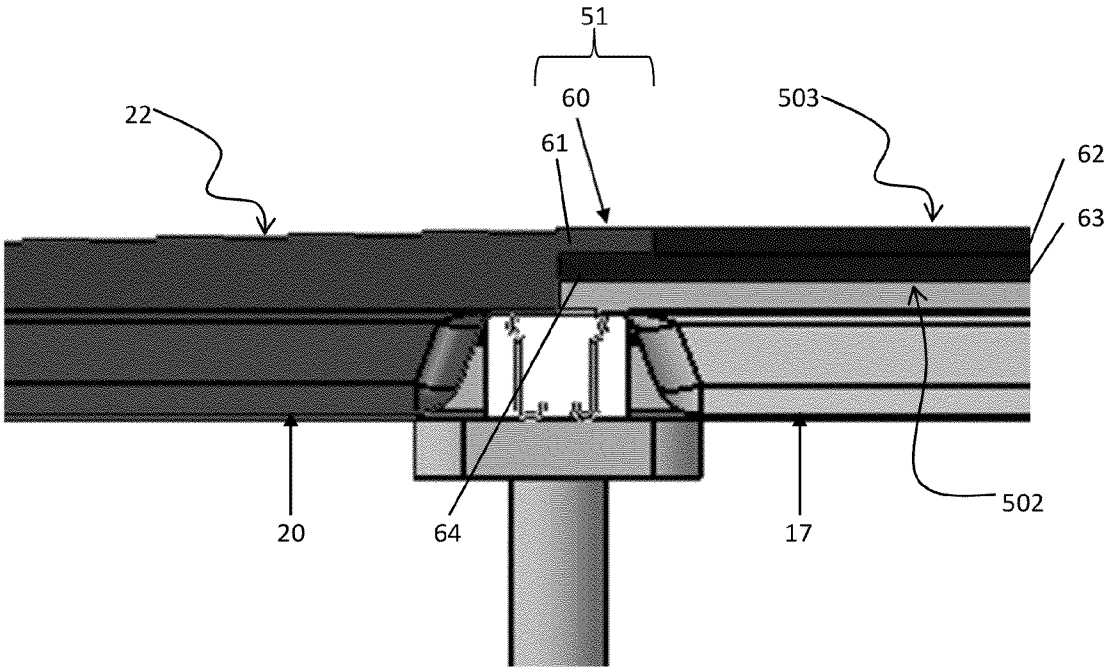
FIG. 3 is a side view of a lap joint in accordance with further embodiments of the invention.
Figure 4:
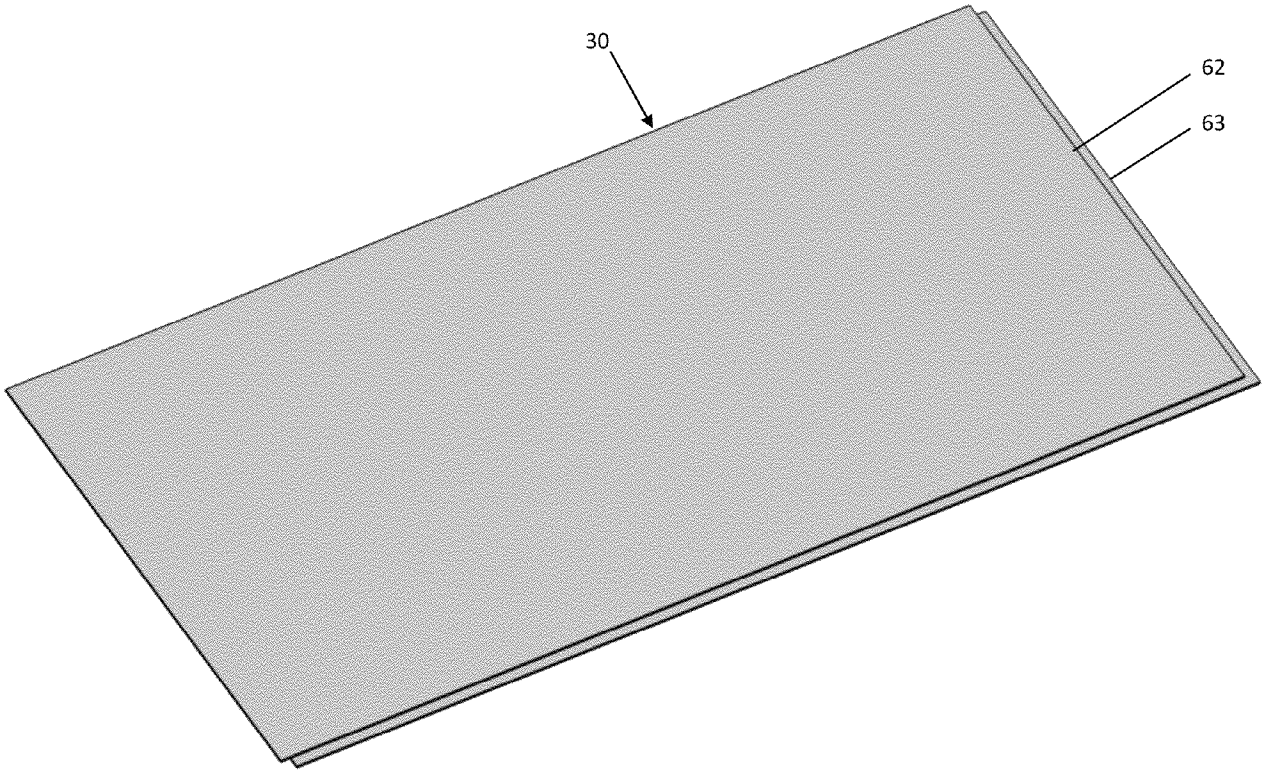
FIG. 4 is a perspective view of first and second offset layers of sheeting for use with the lap joint of FIG. 3.

With reference to FIGS. 3 and 4, the support system 10 may further include a lap joint 60 that is defined by an interface of the second edge 24 of the ramp 20 and the sheeting 30. As shown in FIGS. 3 and 4, the second edge 24 of the ramp 20 may include a first lap joint flange 61 while the sheeting 30 may include an upper layer 62 and a lower layer 63, which is offset from the upper layer 62 to form a second lap joint flange 64. The second lap joint flange 64 is configured to mate with the first lap joint flange 61. While the first lap joint flange 61 is illustrated in FIGS. 3 and 4 as being the upper flange in the lap joint 60 it is to be understood that this is merely illustrative and that the first and second lap joint flanges 61 and 64 could have a reversed configuration as well.

Figure 5:
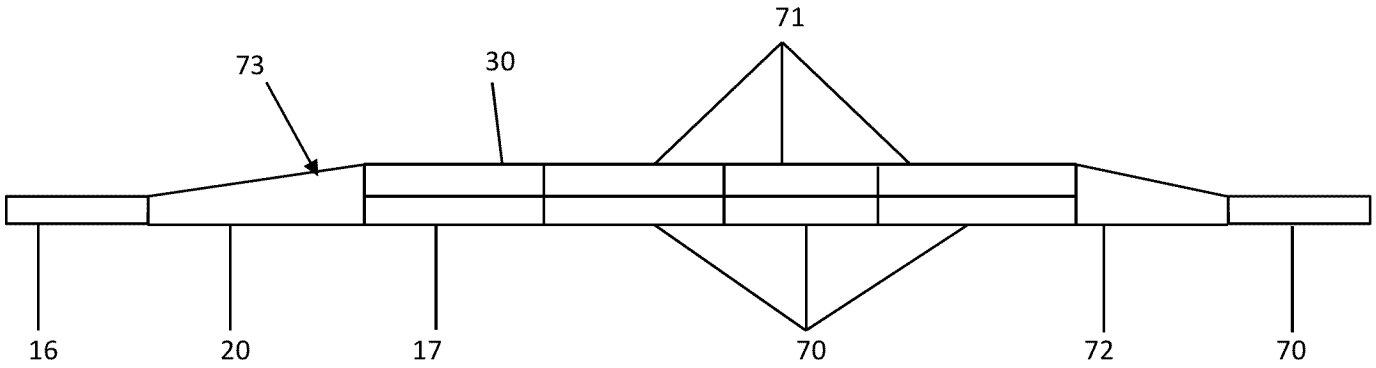
FIG. 5 is a side schematic view of the support system of FIG. 1 in accordance with further embodiments of the present invention.

In accordance with further embodiments and, with reference to FIG. 5, it is to be understood that the support system 10 may include the first and second raised floor tiles 16 and 17, the ramp 20, the sheeting 30, additional raised floor tiles 70 and additional sheeting 71 as well as, in some cases, one or more additional ramps 72. Such additional features can be disposed in series or in parallel with one another to form an elongated or widened pathway 73. This pathway 73 can be formed with a simple geometry or complex geometries, if necessary. For example, if the cabinet 11 is narrower than the features described herein and can be moved from one place to another in a straight line, the pathway 73 would probably be formed along a straight line. However, if the cabinet 11 is wider than the features described herein and must be moved around an immovable structural element, the pathway 73 may need to be widened and formed with one or more angular turns.

Figure 6:
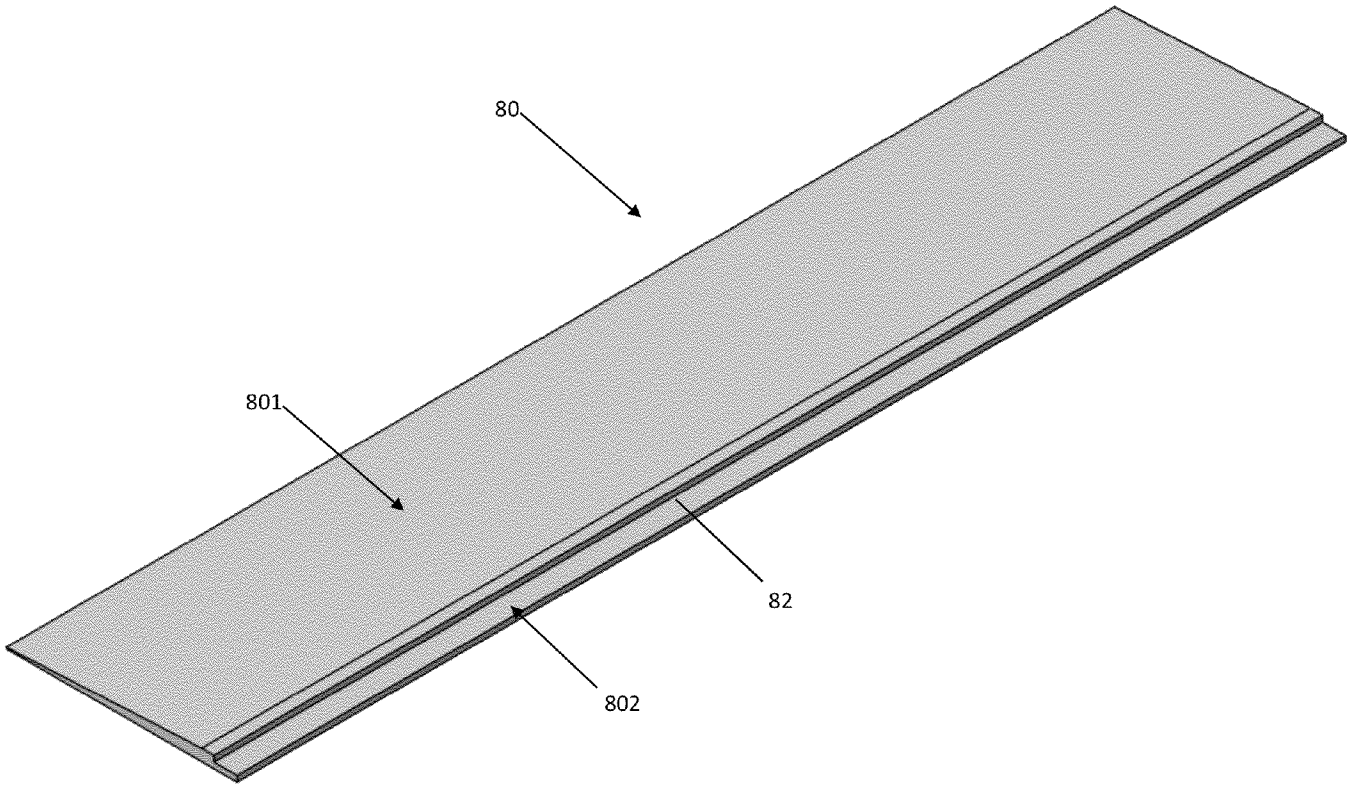
FIG. 6 is a perspective view of a ramp of a support system in accordance with alternative embodiments of the present invention.

In accordance with alternative aspects of the invention, the support system 10 may need to be provided for moving the cabinet 11 along the substrate 13 before reaching the tile floor 15. In this case, with reference to FIGS. 4 and 6, the support system 10 includes a ramp 80 and the sheeting 30 as illustrated in FIG. 4 that are both disposed directly on the substrate 13. As shown in FIG. 6, the ramp 80 has a lead portion 801 and a rear portion 802. The lead portion 801 is formed as a ramp element and the rear portion 802 is formed as a landing with a first lap joint flange 82. As described above, the sheeting 30 has upper and lower offset layers 62 and 63, which are offset from one another to form a second lap joint flange 64. The ramp 80 and the sheeting 30 are disposable such that the first and second lap joint flanges 82 and 64 mate with respective upper surfaces of the ramp 80 and the sheeting 30 having substantially similar heights.

The sheeting 30 may be anchored, for example, against a structural feature. Thus, the cabinet 11 can be rolled up onto the ramp 80 and the sheeting 30 without causing the ramp 80 to move along the substrate 13.

Figure 7:
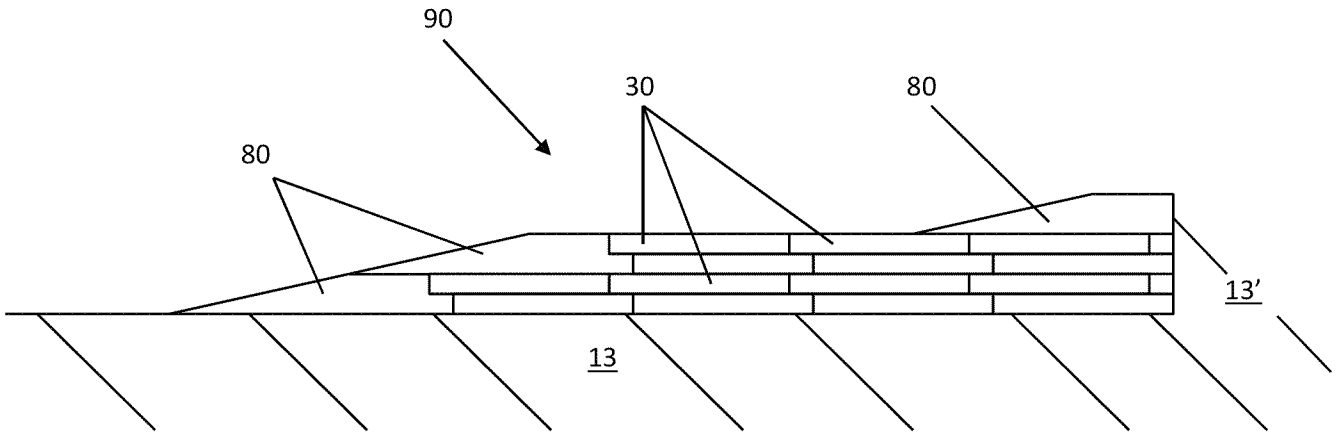
FIG. 7 is a side schematic view of features of the support system of FIG. 6.

In accordance with further embodiments and, with reference to FIG. 7, it is to be understood that at least one of the ramp 80 and the sheeting 30 may be provided as a plurality of ramps 80 and/or sheeting 30. These may then be disposed in parallel or in series with one another to form an extended or widened ramp 90 with simple or complex geometries.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A support system, comprising:

first and second raised floor tiles; and a ramp including first and second edges, which is disposable with the first edge adjacent to the first raised floor tile and the second edge adjacent to the second raised floor tile, the ramp having a substantially similar thickness as the first raised floor tile at the first edge and a different thickness from the second raised floor tile at the second edge; and sheeting, which is disposable on the second raised floor tile to abut the second edge of the ramp, the sheeting having a thickness such that a combined thickness of the sheeting and the second raised floor tile is substantially similar to the thickness of the ramp at the second edge.

2. The support system according to claim 1, wherein the support system comprises a concrete substrate.

3. The support system according to claim 2, wherein the support system comprises a plurality of stanchions and cross-beams to support the first and second raised floor tiles and the ramp above the substrate.

4. The support system according to claim 1, wherein each of the first and second raised floor tiles and the ramp comprises a base portion and a surface portion that overhangs beyond edges of the base portion.

5. The support system according to claim 1, wherein the sheeting comprises one or more of polycarbonate, aluminum, steel and wood.

6. The support system according to claim 1, further comprising:

a first relatively smooth transition defined between an upper surface of the first raised floor tile and an upper surface of the ramp; and a second relatively smooth transition defined between the upper surface of the ramp and an upper surface of the sheeting.

7. The support system according to claim 1, further comprising a lap joint defined by an interface of the second edge of the ramp and the sheeting.

8. The support system according to claim 1, wherein the second edge of the ramp comprises a first lap joint flange, the sheeting comprises upper and lower offset layers, which are offset from one another to form a second lap joint flange, and the second lap joint flange is configured to mate with the first lap joint flange.

9. The support system according to claim 1, further comprising additional raised floor tiles and additional sheeting.

10. The support system according to claim 9, further comprising one or more additional ramps.

11. A support system, comprising:

a substrate on which stanchions and cross-beams are arrayed;

first and second raised floor tiles and a ramp supported by the stanchions and cross-beams above the substrate;

the ramp including first and second edges and being disposable with the first edge adjacent to the first raised floor tile and the second edge adjacent to the second raised floor tile, the ramp having a substantially similar thickness as the first raised floor tile at the first edge and a different thickness from the second raised floor tile at the second edge; and sheeting, which is disposable on the second raised floor tile to abut the second edge of the ramp, the sheeting having a thickness such that a combined thickness of the sheeting and the second raised floor tile is substantially similar to the thickness of the ramp at the second edge.

12. The support system according to claim 11, wherein each of the first and second raised floor tiles and the ramp comprises a base portion and a surface portion that overhangs beyond edges of the base portion.

13. The support system according to claim 11, wherein the sheeting comprises one or more of polycarbonate, aluminum, steel and wood.

14. The support system according to claim 11, further comprising:

a first relatively smooth transition defined between an upper surface of the first raised floor tile and an upper surface of the ramp; and a second relatively smooth transition defined between the upper surface of the ramp and an upper surface of the sheeting.

15. The support system according to claim 11, further comprising a lap joint defined by an interface of the second edge of the ramp and the sheeting.

16. The support system according to claim 11, wherein the second edge of the ramp comprises a first lap joint flange, the sheeting comprises upper and lower offset layers, which are offset from one another to form a second lap joint flange, and the second lap joint flange is configured to mate with the first lap joint flange.

17. The support system according to claim 11, further comprising additional raised floor tiles and additional sheeting.

18. The support system according to claim 17, further comprising one or more additional ramps.

* * * * *